United States Patent [19]

Kurosawa et al.

[11] Patent Number: 4,704,506

[45] Date of Patent: Nov. 3, 1987

[54] VACUUM INTERRUPTER

[75] Inventors: Yukio Kurosawa; Kiyoji Iwashita; Morihisa Matumoto; Takanao Kurasawa; Syunkichi Endo, all of Hitachi, Japan

[73] Assignee: Hitachi, Ltd., Tokyo, Japan

[21] Appl. No.: 881,961

[22] Filed: Jul. 3, 1986

[30] Foreign Application Priority Data

Jul. 12, 1985 [JP] Japan ..... 60-152268

[51] Int. Cl.[4] ..... H01H 33/66

[52] U.S. Cl. ..... 200/144 B

[58] Field of Search ..... 200/144 B

[56] References Cited

U.S. PATENT DOCUMENTS 3,764,764 10/1973 Takasuna et al. ..... 200/144 B

FOREIGN PATENT DOCUMENTS 3400190 7/1984 Fed. Rep. of Germany ... 200/144 B

*Primary Examiner*—Robert S. Macon

*Attorney, Agent, or Firm*—Antonelli, Terry & Wands

[57] ABSTRACT

A cylindrical coil electrode incorporated in a vacuum interrupter comprises a cylindrical body having an opening at one end thereof, two electrical connections provided between the edge surface of the opening of the cylindrical body and a main electrode, two arcuate slits formed on the cylindrical body between the two electrical connections, two arcuate current paths formed in the cylindrical body by the arcuate slits beginning as a respective electrical connection and ending at a rod, and two current blocking slits formed on the cylindrical body at positions where one end of each of the current paths laps the other end of the other current paths. Because of the above structure, one-turn current flows throughout the current paths so that a uniform axial magnetic field can be applied to the main electrode, and an arc current can be uniformly distributed over the entire surface of the main electrode, thereby improving the current interruption performance of the vacuum interrupter.

7 Claims, 4 Drawing Figures

VACUUM INTERRUPTER

BACKGROUND OF THE INVENTION

1. Field of the Invention

This invention relates to a vacuum interrupter including an improved cylindrical coil electrode.

2. Description of the Prior Art

A vacuum interrupter for interrupting a large current includes generally a pair of main electrodes disposed in a vacuum vessel so as to be movable toward and away from each other, coil electrodes mounted on the rear surfaces of the main electrodes, and rods extending to the exterior of the vacuum vessel from the rear surfaces of the coil electrodes. Current flows from one of the rods to the other through the coil electrodes and main electrodes. When one of the rods is urged by an actuator for interrupting the current, one of the main electrodes moves away from the other main electrode, and an arc current is generated to flow across the two main electrodes. This arc current is dispersed into filament-like arc currents and finally extinguished when an axial magnetic field produced by the current flowing through the coil electrodes is applied to the arc current.

Such a coil electrode is disclosed in, for example, U.S. Pat. No. 3,946,179. In the coil electrode disclosed in this U.S. patent, arms connected at one end thereof to a rod extend in a radial direction to be connected at the other end thereof to one end of arcuate sections respectively, and the arcuate sections extend in a circumferential direction to be electrically connected to the other end thereof to a main electrode. Thus, an arm and an associated arcuate section constitute a so-called L-shaped conductive member. Four L-shaped conductive members are mounted to the rod, and a clearance is formed between the adjacent ones of the four arcuate sections arranged in a circular pattern.

Current flows through the coil electrode via the route of the rod-arms-arcuate sections to the main electrode. Because of the presence of the clearances, the current flows through the four arcuate sections in the same direction, that is, the current flows substantially through an imaginary coil of one turn. This one-turn current produces a uniform axial magnetic field which acts to extinguish an arc current flowing across the main electrodes.

Thus, the clearances present in the known coil electrode play an important role for generation of a uniform axial magnetic field in the arcuate sections. In spite of such a great effect exhibited by the clearances, the known coil electrode is defective in that the axial magnetic field is weak in the vicinity of the clearances. Generally, an arc current has such a tendency that it migrates from a low intensity portion toward a high intensity portion of an axial magnetic field. Therefore, the arc current flowing through the portions of the main electrode near the clearances migrates toward the central area of the main electrode where the intensity of the axial magnetic field is high, and concentration of the arc current to the central area of the main electrode having the high field intensity results in localized overheating of the main electrode, thereby degrading the capability of current interruption. Since, also, the entire area of the main electrode cannot be effectively utilized for the current interruption, it becomes necessary to increase the size of the main electrode.

SUMMARY OF THE INVENTION

It is a primary object of the present invention to provide a small-sized vacuum interrupter which can operate with an improved current interruption performance.

A coil electrode incorporated in a preferred embodiment of the vacuum interrupter according to the present invention comprises a cylindrical body having an opening at one end thereof, a plurality of electrical connections provided between the edge surface of the opening of the cylindrical body and a main electrode, at least two arcuate slits formed on the cylindrical body between each of the electrical connections and another electrical connection, arcuate current paths formed in the cylindrical body by the arcuate slits and connected at one end thereof to the electrical connections respectively and at the other end thereof to a rod, and current blocking means formed between one end and the other end of the cylindrical body at positions where one end of each of the current paths laps the other end of another current path. Because of the above structure, one-turn current flows throughout the current paths so that a uniform axial magnetic field can be applied to the main electrode, and an arc current can be uniformly distributed over the entire surface of the main electrode, thereby improving the current interruption performance of the vacuum interrupter.

DESCRIPTION OF THE PREFERRED EMBODIMENTS

A preferred embodiment of the vacuum interrupter according to the present invention will be explained with reference to FIG. 1

Figure 1:
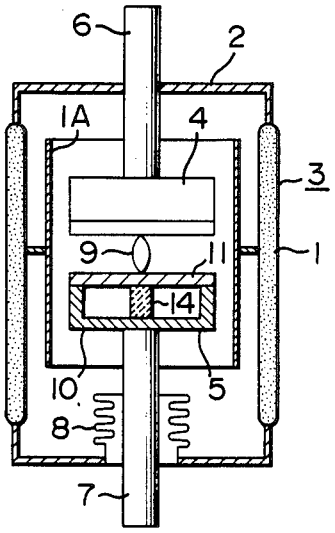
FIG. 1 is a partly sectional, schematic side elevation view of a preferred embodiment of the vacuum interrupter according to the present invention.

Referring to FIG. 1, a vacuum vessel 3 is formed by mounting a pair of end plates 2 on both ends of a cylindrical member 1 of an electrical insulating material. A stationary electrode 4 and a movable electrode 5 are disposed opposite to each other in the vacuum vessel 3, and a pair of rods 6 and 7 extend to the exterior of the vacuum vessel 3 from the rear surfaces of these electrodes 4 and 5 respectively. A bellows 8 is mounted between one of the rods or the rod 7 and the associated end plate 2. The bellows 8 acts to drive an actuator (not shown) mounted on the rod 7 so as to permit movement of the rod 7 in its axial direction. When the rod 7 is urged in its axial direction, the movable electrode 5 is electrically moved away from the stationary electrode 4, and an arc current 9 generated between these two electrodes 4 and 5 produces metal vapor.

The metal vapor attaches to an intermediate shield 1A supported in the insulating cylindrical member 1, and the arc is extinguished by being dispersed by a magnetic field H generated in the axial direction of a cylindrical coil electrode 10. This cylindrical coil electrode 10 is provided in each of the stationary and movable electrodes 4 and 5. Herein, the cylindrical coil electrode 10 provided in the movable electrode 5 will be explained with reference to FIGS. 2 and 3. However, the cylindrical coil electrode 10 may be provided in at least one of the electrodes 4 and 5.

Figure 2:
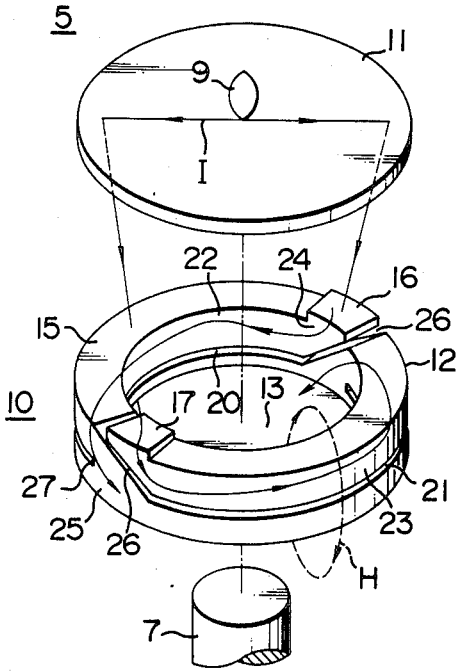
FIGS. 2 and 3 are schematic perspective views of the electrodes incorporated in the vacuum interrupter shown in FIG. 1.
Figure 3:
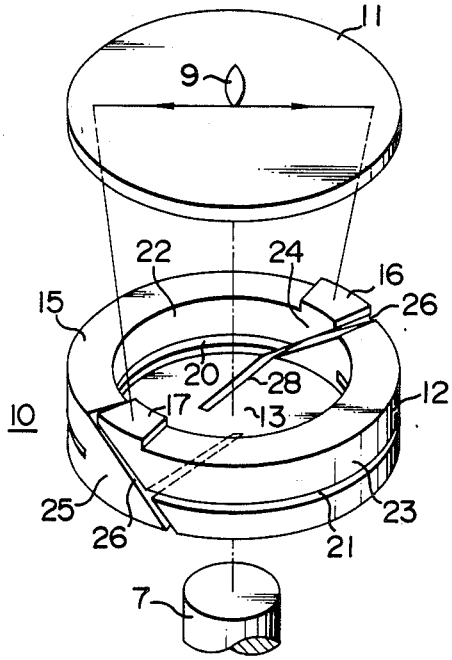

Referring to FIGS. 2 and 3, the cylindrical coil electrode 10 is mounted to the rear surface of a main electrode 11 and includes a cylindrical body 12 having an opening at one end and a closed bottom 13 at the other end. A spacer 14 made of a high resistance material, for example, a stainless steel, is disposed between the main electrode 11 and the bottom 13 of the cylindrical body 12. A pair of projections 16 and 17 are formed on the end edge surface 15 of the opening of the cylindrical body 12, and the main electrode 11 is electrically connected to the projections 16 and 17. These projections may be formed on the main electrode 11. Arcuate slits 20 and 21 are cut in the semicircular cylindrical portions respectively of the cylindrical body 12 between the projections 16 and 17 to form two arcuate current paths 22 and 23.

The current paths 22 and 23 are connected at, for example their input ends 24, to the projections 16 and 17, and at the other end thereof, for example their output ends 25, to the rod 7 through the bottom 13 of the cylindrical body 12. Inclined slit 26 are formed at positions of the cylindrical body 12 where the input ends 24 and the associated output ends 25 of the current paths 22 and 23 lap each other. One end of each of the inclined slits 26 communicates with one end 27 of the associated arcuate slit 21 or 22, and the other end thereof extends from the other slit end 27 toward and into the associated portion of the end edge surface 15 of the opening of the cylindrical body 12. Therefore, the input and output ends 24 and 25 of the current path 22 are electrically separated from the output and input ends 25 and 24 of the current path 23 respectively. As shown in FIG. 3, at positions near the output ends 25 of the current paths 22 and 23, slits 28 extend from the slits 26 along the bottom 13 to terminate at positions adjacent to the rod 7, thereby preventing induction of an eddy current due to the axial magnetic field H produced by the cylindrical coil electrode 10.

Figure 4:
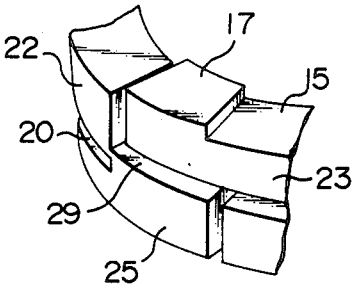
FIG. 4 is a schematic perspective view of part of another form of the coil electrode shown in FIGS. 2 and 3.

The inclined slit 26 may be replaced by a stepped slit 29 as shown in FIG. 4. Further, the inclined slit 26 or the stepped slit 29 may be replaced by a member of a high resistance material, for example, a stainless steel. The requirement is that current flowing from the input end toward the output end of one of the current paths can be separated from current flowing from the input end toward the output end of the other current path, so that current of one turn of an imaginary coil can flow throughout the current paths.

Then, when the movable electrode 5 is parted away from the stationary electrode 4 to interrupt the current flow, an arc current 9 flows across the two electrodes 4 and 5. As shown by the arrows, the arc current 9 flows through the projections 16 and 17 into the current paths 22 and 23 from the input ends 24 and flows then into the rod 7 from the output ends 25 through the bottom 13 of the cylindrical body 12.

It will be seen from the above description of the present invention that current flowing into and flowing out from the lapping input ends 24 and output ends 25 of the current paths 22 and 23 is equivalent to current flowing through one turn of an imaginary coil. Thus, an axial magnetic field H produced by such a current is uniformly applied over the entire surface of the main electrode 11, and the arc current 9 is uniformly distributed over the entire surface of the main electrode 11. Therefore, the current interruption performance can be improved, and the vacuum interrupter can be reduced in its overall size because of the capability of effective utilization of the entire surface of the main electrode for current interruption.

In the aforementioned embodiments, only two projections 16 and 17 are provided on the cylindrical body 12. However, provision of more than two projections, for example, four, six or more projections can further reduce the overall size of the vacuum interrupter, because current is further dispersed to prevent localized overheating at the projections. In such a case, it is preferable to provide the arcuate slits and current paths in the number which is the same as the number of the projections.

Further, the intensity of an eddy current generated by a magnetic field produced by current flowing through the bottom 13 of the cylindrical body 12 is limited by the presence of the slits 28, and the resultant magnetic flux is not strong enough to cancel the axial magnetic field H. Therefore, an undesirable intensity reduction of the axial magnetic field H can be prevented. In this connection, provision of more slits 28 can further prevent an undesirable reduction of the intensity of the axial magnetic field H. Thus, when a plurality of slits are formed in the main electrode 11, not only an intensity reduction of the axial magnetic field H can be lessened, but also a better cooling effect can be exhibited.

It will be understood from the foregoing descriptions that the present invention can provide a small-sized vacuum interrupter operable with an improved current interruption performance

We claim:

1. A vacuum interrupter comprising:

at least one pair of substantially disk-shaped main electrodes disposed in a vacuum vessel so as to be movable toward and away from each other;

rods extending out of said vacuum vessel from rear surfaces of said main electrodes respectively; and a cylindrical coil electrode means electrically connected between the rear surface of at least one of said main electrodes and an associated rod through a member of a high resistance material for producing an axial magnetic field for dispersing arc current formed on said main electrodes substantially radially over the surface of at least one of said main electrodes, said cylindrical coil electrode means including:

a cylindrical body having an opening at one end thereof, a plurality of electrical connections provided between an edge surface of the opening of said cylindrical body and one of said main electrodes, a plurality of arcuate slits formed on said cylindrical body extending substantially between adjacent ones of said plurality of electrical connections, a plurality of arcuate current paths formed in said cylindrical body by said arcuate slits, for dispersing said arc current from said plurality of electrical connections to one of said rods, and current blocking means formed on said cylindrical body between each of said arcute current paths, respectively, for blocking current in one of said arcuate current paths from flowing into another of said arcuate current paths, whereby arc current formed on said main electrodes is dispersed substantially radially over the surface of at least one of said main electrodes.

2. A vacuum interrupter as claimed in claim 1, wherein each of said current blocking means is an inclined slit communicating at one end thereof with one end of said arcuate slits and extending toward a portion of said edge surface of said cylindrical body corresponding to one end of another arcuate slit.

3. A vacuum interrupter as claimed in claim 1, wherein each of said current blocking means is a stepped slit communicating at one end thereof with one end of one of said arcuate slits and extending toward a portion of said edge surface of said cylindrical body corresponding to one end of another arcuate slit.

4. A vacuum interrupter as claimed in claim 1, wherein each of said current blocking means comprises a high resistance material disposed between one end of one of said arcuate slits and a portion of said edge surface of said cylindrical body corresponding to one end of another arcuate slit.

5. A vacuum interrupter as claimed in claim 2, wherein each of said current blocking means comprises a high resistance material disposed between one end of one of said arcuate slits and a portion of said edge surface of said cylindrical body corresponding to one end of another acuate slit.

6. A vacuum interrupter as claimed in claim 3, wherein each of said current blocking means comprises a high resistance material disposed between one end of one of said arcuate slits and a portion of said edge surface of said cylindrical body corresponding to one end of another arcuate slit.

7. A vacuum interrupter as claimed in claim 1, wherein said cylindrical body is provided with a bottom to which said rod is connected, and each of said current blocking means further extends along said bottom to terminate at a position adjacent to said rod.

* * * * *